US007647709B2

(12) United States Patent
Reilly et al.

(10) Patent No.: US 7,647,709 B2
(45) Date of Patent: Jan. 19, 2010

(54) FOOTWEAR WITH A SHANK SYSTEM

(75) Inventors: Mark Reilly, Tigard, OR (US); Kent Thomas, Camas, WA (US); Stephen Belatti, Portland, OR (US); Ryan Dowd, Portland, OR (US)

(73) Assignee: Danner, Inc., Portland, OR (US)

( * ) Notice: Subject to any disclaimer, the term of this patent is extended or adjusted under 35 U.S.C. 154(b) by 390 days.

(21) Appl. No.: 11/437,266

(22) Filed: May 19, 2006

(65) Prior Publication Data

US 2006/0277798 A1 Dec. 14, 2006

Related U.S. Application Data

(60) Provisional application No. 60/682,923, filed on May 19, 2005.

(51) Int. Cl.
*A43B 13/12* (2006.01)
*A43B 7/14* (2006.01)

(52) U.S. Cl. ..... 36/30 R; 36/107; 36/88

(58) Field of Classification Search ..... 36/88, 36/91, 92, 107, 108, 30 R
See application file for complete search history.

(56) References Cited

U.S. PATENT DOCUMENTS

| | | | |
|---|---|---|---|
| 392,677 | A | 11/1888 | King |
| 406,338 | A | 7/1889 | Cross |
| 1,602,675 | A | 10/1926 | Hurley |
| 1,709,735 | A | 4/1929 | Parlante |
| 2,005,048 | A | 6/1935 | Randall |
| 2,038,528 | A | 4/1936 | McCarthy |

(Continued)

FOREIGN PATENT DOCUMENTS

| | | |
|---|---|---|
| AU | 2003284372 | 5/2004 |

(Continued)

OTHER PUBLICATIONS

Great Outdoors "Nike ACG Men's Air Switchblade (Closeout) Approach Shoe ON SALE!" Accessed May 6, 2005. 2 Pages. http://www.greatoutdoors.com/nikeacg/footwear/mensairswitchbladeapproachshoe.html.

(Continued)

*Primary Examiner*—Marie Patterson
(74) *Attorney, Agent, or Firm*—Perkins Coie LLP

(57) ABSTRACT

An aspect of the present invention includes a footwear assembly comprising: an upper and a sole assembly connected to the upper. The sole assembly has a footwear assembly comprising a sole assembly connected to an upper. The sole assembly has a midsole made of a first material and having a forefoot portion, an arch portion, a heel portion, and a sidewall extending around a lateral side, a medial side, and a heel side of the midsole. A stiffener is connected to the midsole. The stiffener is made of a second material stiffer than the first material. The stiffener has a base portion adjacent to the arch portion and at least one of the forefoot portion and the heel portion of the midsole. The stiffener has a side stabilizer and a heel wrap coupled to the base portion. The side stabilizer is adjacent to the sidewall in at least one of the arch portion and forefoot portion. The heel wrap is adjacent to the heel side and at least one of the lateral side and medial side of the midsole's sidewall.

39 Claims, 13 Drawing Sheets

U.S. PATENT DOCUMENTS

| | | | | |
|---|---|---|---|---|
| 4,224,748 | A | 9/1980 | Whitchurch | |
| 4,580,359 | A | 4/1986 | Kurrash et al. | |
| 4,766,679 | A * | 8/1988 | Bender | 36/30 R |
| 4,869,001 | A | 9/1989 | Brown | |
| 4,918,776 | A | 4/1990 | Motoda et al. | |
| 4,947,560 | A * | 8/1990 | Fuerst et al. | 36/88 |
| 5,046,267 | A | 9/1991 | Kilgore et al. | |
| 5,452,526 | A | 9/1995 | Collins et al. | |
| 5,491,909 | A | 2/1996 | Darby | |
| 5,729,918 | A | 3/1998 | Smets | |
| 5,933,896 | A | 8/1999 | Gallina et al. | |
| 6,000,148 | A * | 12/1999 | Cretinon | 36/88 |
| 6,018,889 | A | 2/2000 | Friton | |
| 6,055,745 | A | 5/2000 | Endoh et al. | |
| 6,061,929 | A | 5/2000 | Ritter | |
| 6,092,305 | A | 7/2000 | Troy et al. | |
| 6,132,663 | A | 10/2000 | Johnson et al. | |
| 6,226,896 | B1 | 5/2001 | Friton | |
| 6,321,469 | B1 * | 11/2001 | Cretinon | 36/102 |
| 6,401,366 | B2 * | 6/2002 | Foxen et al. | 36/91 |
| 6,412,196 | B1 * | 7/2002 | Gross | 36/102 |
| 6,484,420 | B1 | 11/2002 | Chi et al. | |
| 6,497,058 | B2 * | 12/2002 | Dietrich et al. | 36/69 |
| 6,519,876 | B1 | 2/2003 | Geer et al. | |
| 6,625,905 | B2 * | 9/2003 | Kita | 36/30 R |
| 6,757,990 | B2 | 7/2004 | Chi et al. | |
| 6,775,930 | B2 * | 8/2004 | Fuerst | 36/103 |
| 6,845,572 | B1 | 1/2005 | Haimerl et al. | |
| 7,082,702 | B2 * | 8/2006 | Cretinon | 36/88 |
| 7,299,567 | B2 * | 11/2007 | Berend et al. | 36/88 |
| 2001/0016993 | A1 | 8/2001 | Cagner | |
| 2002/0050078 | A1 * | 5/2002 | Dietrich et al. | 36/88 |
| 2003/0000108 | A1 * | 1/2003 | Kita | 36/28 |
| 2003/0000109 | A1 * | 1/2003 | Kita | 36/30 R |
| 2003/0005600 | A1 | 1/2003 | Kita | |
| 2003/0079373 | A1 | 5/2003 | Geer et al. | |
| 2003/0172548 | A1 * | 9/2003 | Fuerst | 36/28 |
| 2003/0192202 | A1 * | 10/2003 | Schoenborn et al. | 36/30 R |
| 2004/0020081 | A1 | 2/2004 | Symons et al. | |
| 2004/0111920 | A1 * | 6/2004 | Cretinon | 36/30 R |
| 2004/0123495 | A1 | 7/2004 | Greene et al. | |
| 2004/0154188 | A1 | 8/2004 | Laska | |
| 2004/0244226 | A1 | 12/2004 | Farys et al. | |
| 2005/0034328 | A1 | 2/2005 | Geer | |
| 2005/0050769 | A1 | 3/2005 | Haimerl et al. | |
| 2005/0268491 | A1 * | 12/2005 | McDonald et al. | 36/28 |
| 2005/0278980 | A1 * | 12/2005 | Berend et al. | 36/103 |

FOREIGN PATENT DOCUMENTS

| | | |
|---|---|---|
| CA | 2 260 646 | 7/1999 |
| CA | 2493591 | 2/2004 |
| EP | 0098964 | 1/1984 |
| GB | 535504 | 4/1941 |
| GB | 599333 | 3/1948 |
| GB | 706680 | 3/1954 |
| GB | 790567 | 2/1958 |
| GB | 804478 | 11/1958 |
| GB | 859869 | 1/1961 |
| GB | 928131 | 6/1963 |
| GB | 1017847 | 1/1966 |
| GB | 1437329 | 5/1976 |
| GB | 2333689 | 8/1999 |
| GB | 2388520 | 11/2003 |
| JP | 9149805 | 6/1997 |
| JP | 11042103 | 2/1999 |
| JP | 2004167050 | 6/2004 |
| WO | WO-96/04811 | 2/1996 |
| WO | WO-0024282 | 5/2000 |
| WO | WO-0182732 | 11/2001 |
| WO | WO-0182733 | 11/2001 |
| WO | WO-2005/016049 | 2/2005 |

OTHER PUBLICATIONS pwp.com "Wilson—Tennis shoes by Manufacturer" Accessed May 6, 2005. 6 Pages. http://www.pwp.com/womenstennisshoes.asp?id=250&cat=Wilson.

reserve america "The North Face—Men's Bryce Lightweight Hiking Boot (Closeout)" Accessed May 6, 2005. 1 Page. http://reserveamerica.altrec.com/shop/detail/18030/11/photo.

ARS Sutoria, De Grande Produzione, p. 149, Milano, Italy.

ARS sutoria, Issue 114, p. 27, Dec. 1975, Milan, Italy.

ARS sutoria, Issue 211, p. 148, Jun. 1991, Milan, Italy.

ARS sutoria, Issue 223, p. 165, Jan. 1993, Milan Italy.

ARS sutoria, Issue 235, p. 209, Jun. 1994, Milan, Italy.

ARS sutoria, Issue 84, p. 88-89, Mar. 1969, Milan, Italy.

Calza® natura Stepper, Stilman, Foto Shoe, Feb. 2, 1991.

Foto Shoe, Calza®-natura Stepper, Stilman S.p. A.; Dandy Boot®, Lavorazione Artigiana, Aug. 8, 1990.

Rockport, "The ProWalker 7000," 1978, Rockport Walking Institute, Marlboro, Massachusetts.

Complaint and Exhibits A-B with Coversheet and Corporate Disclosure Statement, *Danner, Inc.* v. *Cole Haan Holdings, Inc.*, U.S. District Court of Oregon, Case No. CV'09-258-ST, Mar. 5, 2009, 60 pages.

Civil Case Assignment Order, *Danner, Inc.* v. *Cole Haan Holdings, Inc.*, U.S. District Court of Oregon, Case No. CV'09-258-ST, Mar. 5, 2009, 7 pages.

Notice of Dismissal, *Danner, Inc.* v. *Cole Haan Holdings, Inc.*, U.S. District Court of Oregon, Case No. CV'09-258-ST, Apr. 27, 2009, 1 page.

Danner—Spring 2000 Catalog, Danner, Inc., published at least as early as Aug. 1, 1999, 36 pages.

Danner Radical—Spring 2000 Sales Video (Transcript), Danner, Inc., published at least as early as Aug. 1, 1999, 2 pages.

* cited by examiner

FOOTWEAR WITH A SHANK SYSTEM

CROSS REFERENCE TO RELATED APPLICATIONS

This application claims priority to provisional U.S. patent application Ser. No. 60/682,923, entitled FOOTWEAR WITH EXTERNAL SHANK, filed May 19, 2005, and which is incorporated herein by reference thereto.

TECHNICAL FIELD

The present invention is directed to footwear, and more specifically toward footwear that includes a shank.

BACKGROUND

Boots and other footwear are typically constructed of materials that provide a comfortable, durable, and stable platform. Boots, such as hunting and hiking boots, are constructed with an upper connected to a sole assembly. The sole assembly has an outsole, a midsole, an insole, and an internal shank. Conventional boot construction provides a stable product, although additional stability typically results in a heavier product. It is desirable to maintain the durability and stability of a boot while reducing its weight.

SUMMARY

The present invention overcomes limitations of the prior art and provides additional benefits. At least one embodiment of the invention includes a footwear assembly comprising a sole assembly connected to an upper. The sole assembly comprises a midsole made of a first material and having a forefoot portion, an arch portion, a heel portion, and a sidewall extending around a lateral side, a medial side and a heel side of the midsole. A stiffener is connected to the midsole. The stiffener is made of a second material stiffer than the first material. The stiffener has a base portion adjacent to the arch portion and at least one of the forefoot portion and the heel portion of the midsole. The stiffener has a side stabilizer and a heel wrap coupled to the base portion. The side stabilizer is adjacent to the sidewall in at least one of the arch portion and forefoot portion. The heel wrap is adjacent to the heel side and at least one of the lateral side and medial side of the midsole's sidewall. An outsole is connected to at least one of the midsole and the stiffener.

In another embodiment, an outsole is connected to at least one of the midsole and the stiffener. The midsole is made of a first material and has a plurality of lugs projecting away from the upper and defining recessed areas. A stiffener is connected to the midsole in at least some of the recessed areas. The stiffener has a plurality of apertures, and the plurality of lugs project through the apertures. The midsole has a forefoot portion, an arch portion, and a heel portion, and the stiffener is positioned in the arch portion and in at least one of the forefoot portions and the heel portions. An outsole is connected to the lugs.

A detailed description of the illustrated embodiments of the invention is presented below, which will permit one skilled in the relevant art to understand, make, and use aspects of the invention. One skilled in the relevant art can obtain a full appreciation of aspects of the invention from the subsequent detailed description, read together with the figures, and from the claims, which follow the detailed description.

DETAILED DESCRIPTION

A footwear assembly having a sole with an improved stiffener, such as a shank, is described in detail herein in accordance with embodiments of the present invention. In the following description, numerous specific details are discussed to provide a thorough and enabling description of embodiments of the invention. One skilled in the relevant art, however, will recognize that the invention can be practiced without one or more of the specific details. In other instances, well-known structures or operations are not shown or are not described in detail to avoid obscuring aspects of the invention. In general, alternatives and alternate embodiments described herein are substantially similar to the previously described embodiments, and common elements are identified by the same reference numbers.

Figure 1:
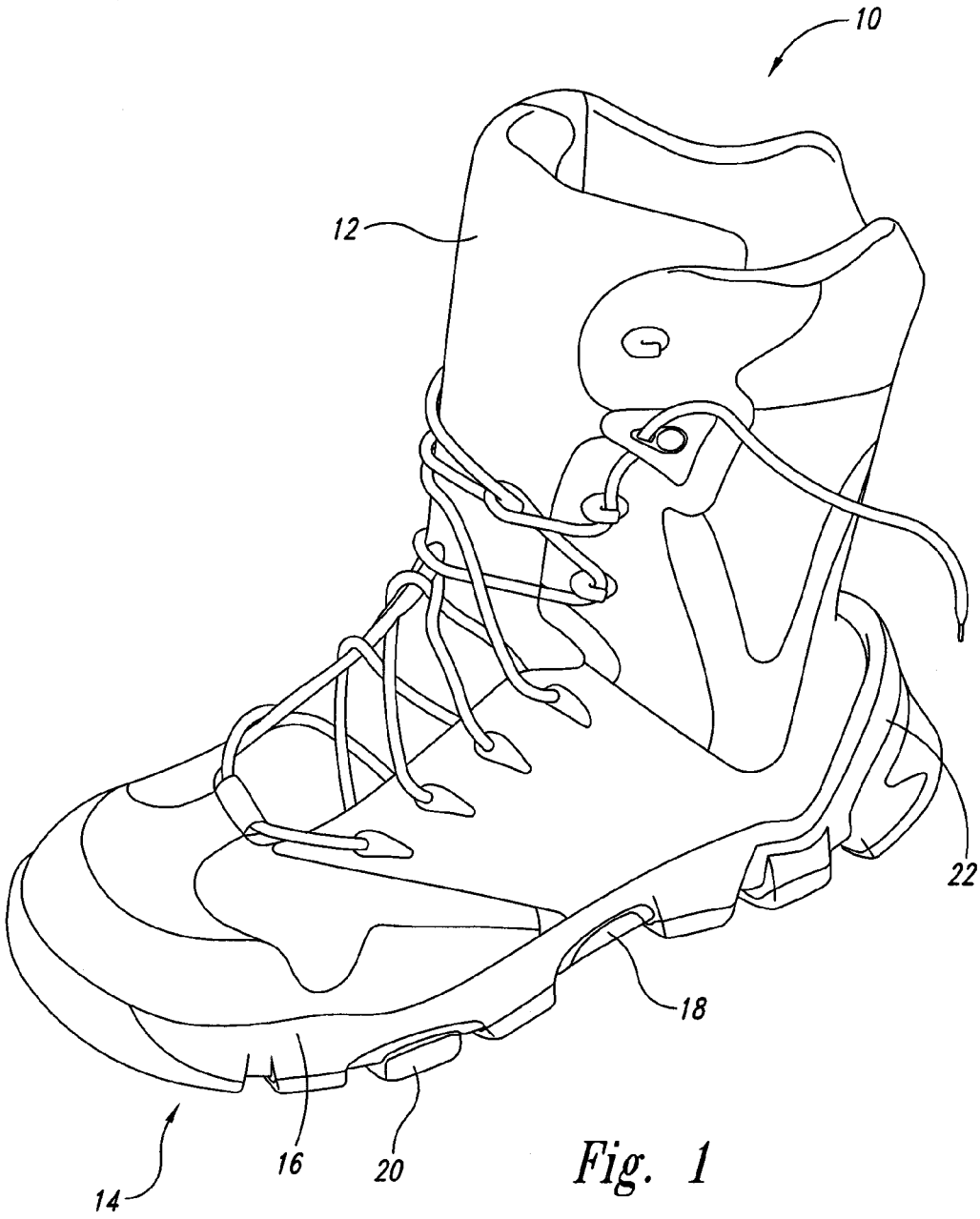
FIG. 1 is an isometric view of a boot assembly having an external shank in accordance with an embodiment of the present invention.
Figure 2:
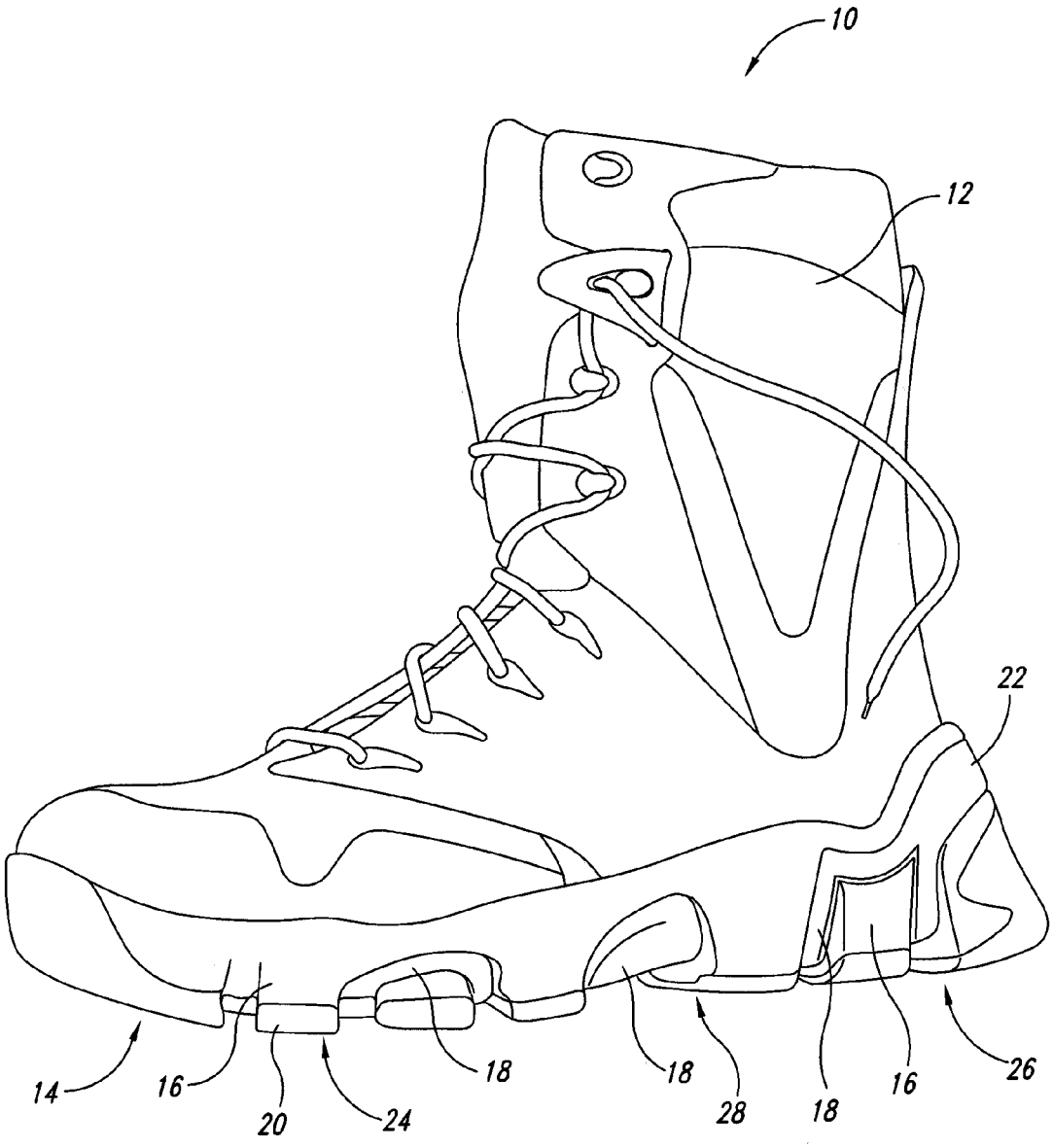
FIG. 2 is an enlarged side view of the boot assembly of FIG. 1 having an external shank.

FIG. 1 is an isometric view of a boot assembly 10 having an upper 12 connected to a sole assembly 14 in accordance with an embodiment of the present invention. FIG. 2 is an enlarged side view of the boot assembly 10. The sole assembly 14 has a lightweight midsole 16 attached to the upper 12, a shank 18 attached to the midsole to provide longitudinal and lateral stiffness and stability, and a durable outsole 20 attached to the midsole. In one embodiment, a plurality of lugs are formed in the middle and the outsole is attached to the lugs. In another embodiment, the lugs are integrally formed in the outsole and the shank is attached to the outsole around the lugs. In another embodiment, the outsole is provided with lugs or other tread features, and the shank is positioned between the midsole and the outsole. Portions of the shank engage the sides of the midsole or other upper portions of the shoe to provide a platform with improved foot support and/or lateral stability. The sole assembly 14 can also include an insole (not shown) in the interior area formed by the sole assembly 14 and the upper 12. The sole assembly can also include a conventional longitudinal shank that works in conjunction with the shank 18 of the present invention.

As discussed in greater detail below, the shank 18 of the illustrated embodiment is at least a partially exposed shank (i.e., an external shank), although the shank in other embodiments can be covered by the outsole or other portions of the midsole assembly. As seen in FIG. 2, the shank can include lateral support portions 21 that extend upwardly away from the outsole and along the side of the midsole 16. Portions of the shank can extend upwardly along portions of the shoe's upper. In other embodiments, portions of the shank can extend along the upper and connect to the shoe's lace system or other elements of the upper's fit system. The shank can also have support portions in the arch portion and/or forefoot portion on the medial and/or lateral and/or lateral sides. The sole assembly 14 has a forefoot portion 24 to support the toes and forefoot of a wearer's foot, an arch portion 26 to support the arch area of the foot, and a heel portion 28 to support the heel area of the foot. The shank can have support portions in the forefoot portion, the arch portion, and/or the heel portion. For example, the shank can have an external heel wrap 22 coupled to the midsole 16 to help form a stable heel cup.

Figure 3:
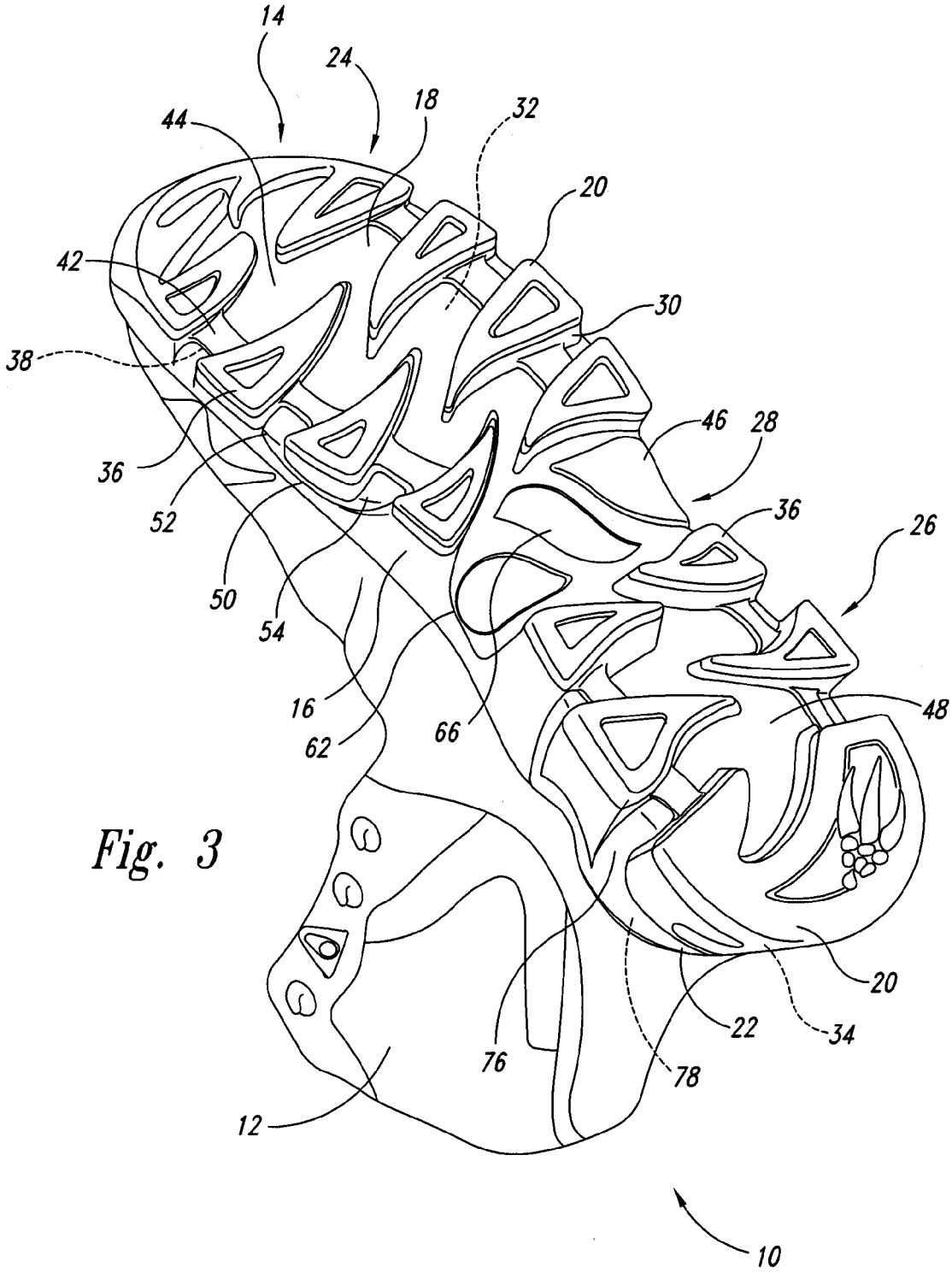
FIG. 3 is an enlarged bottom isometric view of a boot assembly having an external shank.
Figure 4:
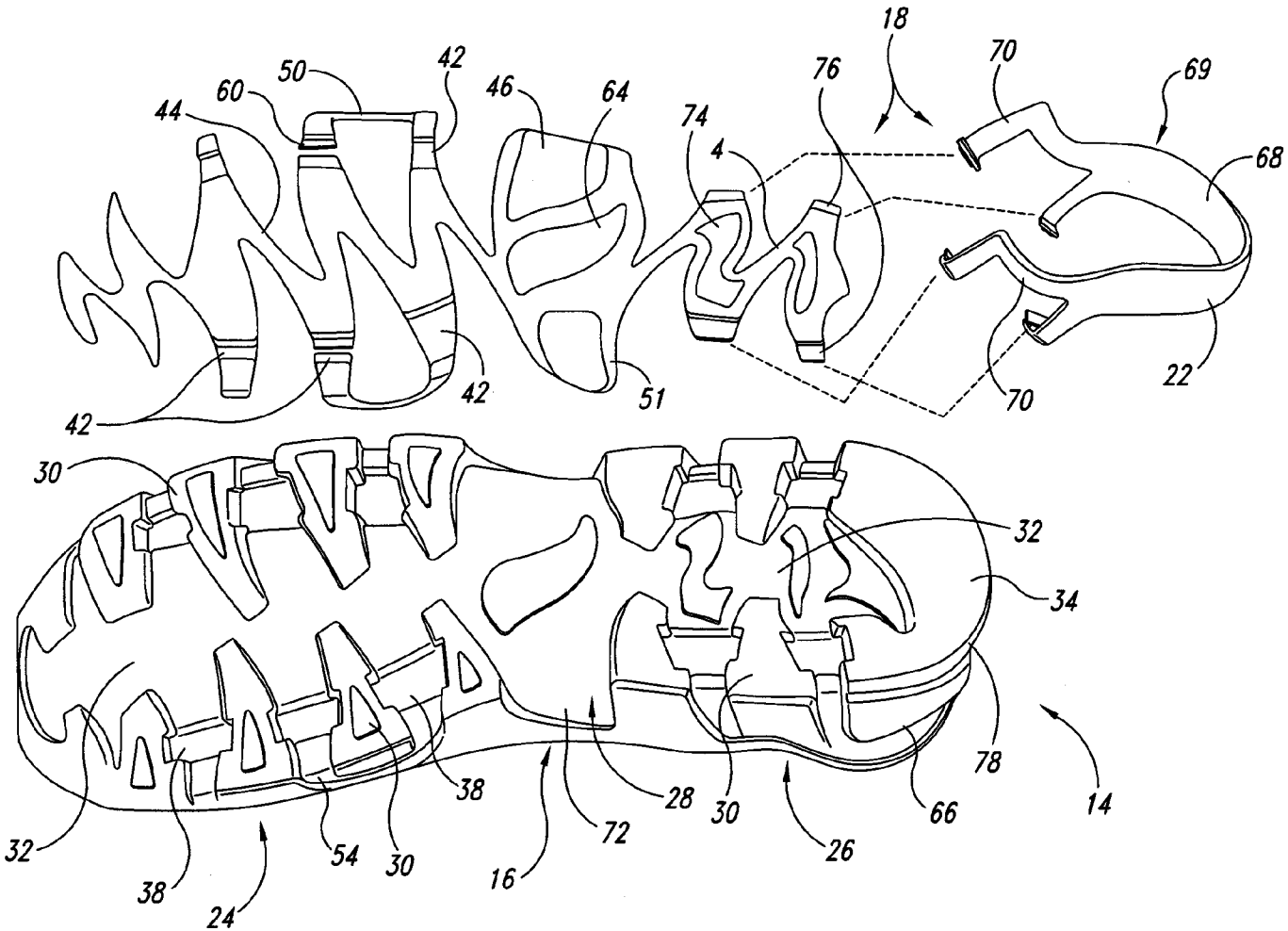
FIG. 4 is an enlarged exploded bottom isometric view of the sole assembly of the boot assembly having a midsole and an external shank with an external heel support (the outsole is not shown).

FIG. 3 is an enlarged bottom isometric view of the boot assembly 10, and FIG. 4 is an enlarged exploded bottom isometric view of the sole assembly 14 shown separated from the upper 12 (FIG. 3). The outsole 20 (FIG. 3) is not shown in FIG. 4 to avoid obscuring other details shown. The sole assembly 14 of the illustrated embodiment has the midsole 16 made of a molded, closed-cell material, such as EVA (Expanded Vinyl Acetate) or other suitable foam or lightweight compressible material. The EVA material provides a lightweight and durable midsole structure with desirable cushioning and shock-absorbing characteristics. The midsole 16 of the illustrated embodiment has a plurality of protruding lugs 30 formed therein that extend away from the upper. The lugs 30 of the illustrated embodiment are raised portions that extend inwardly from the lateral and medial sides of the midsole 16. The lugs 30 are provided in the forefoot portion and the heel portion. At least a portion of the midsole's arch portion is free of lugs, as discussed in greater detail below.

The lugs 30 in the midsole 16 of the illustrated embodiment are spaced apart to define a contoured recessed portion 32 formed in the midsole. The recessed portion 32 extends substantially the length of the midsole 16 from the forefoot portion through the arch portion to the heel portion. The midsole 16 of the illustrated embodiment also has an enlarged heel lug 34 positioned in a heel strike area. The enlarged heel lug 34 provides a thick portion of EVA for additional cushioning and shock absorption for absorbing forces, for example, during heel strike. The midsole 16 of the illustrated embodiment also has a plurality of molded channel portions 38 extending generally longitudinally adjacent to the medial and lateral side portions of the midsole. The channel portion 38 extends between the lugs 30 (in the forefoot and heel portions, respectively). Other embodiments can have the channel portions 38 formed in other areas of the midsole, such as the arch portion. The channel portions 38 can be recessed areas that receive portions of the external shank 18.

In one embodiment, the midsole 16 may be manufactured from a dual density material such that the outer exterior surface of the midsole, particularly along the sidewall, can be a more dense and durable material. The internal portions of the midsole 16 can be manufactured of a less dense material well suited for cushioning and shock absorption. The denser exterior surface of the midsole 16 can help provide for increased durability and wear resistance of the sole assembly 14.

As best seen in FIGS. 3 and 4, the outsole 20 of the illustrated embodiment is comprised of a plurality of outsole sections 36 adhered to the bottom surface of the lugs 30 and the heel lug 34. The outsole sections 36 are, therefore, spaced apart from the recessed portion 32 in the illustrated embodiment. The outsole sections 36 are made of a conventional durable rubber material that has been used for footwear outsoles. The outsole sections 36 are shaped and sized to substantially correspond to the shape of the lugs 30 and the heel lug 34. Accordingly, the outsole sections 36 of the illustrated embodiment define the surface that engages the ground when the boot assembly is worn by a user. In the illustrated embodiment, the outsole section 36, connected to the heel lug 34, wraps upwardly around the midsole's heel portion and is positioned along a sidewall of the heel portion. The outsole sections 36 are adhered to the lugs 30 and heel lug 34 of the midsole by conventional adhesive or other conventional attachment mechanisms. The outsole sections 36 can be contoured to provide additional traction or an aesthetic appearance of the sole assembly 14.

In the illustrated embodiment, the outsole 20 does not cover the shank 18. In another embodiment, the outsole 20 is a substantially full-length outsole so that the shank 18 is not visible from the bottom of the boot, except perhaps for lateral and medial stabilizing portions of the shank that extend up along the sidewalls of the midsole at the arch portion, the forefoot portion, and/or the heel portion.

The shank 18 of the illustrated embodiment is a full-length external shank that extends under the forefoot, arch, and heel portions, 24, 26, and 28, respectively, of the midsole 16. The shank 18 of the embodiment of FIG. 3 is shaped and sized to fit within the recessed portion 32 formed in the midsole 16. The external shank 18 in another embodiment is also a full-length external shank having a plurality of lug apertures and lugs formed in the outsole extending through the lug apertures in the shank. The external shank 18 of the illustrated embodiment is formed of a fairly stiff material that provides the support and stiffness needed along the longitudinal length of the midsole and laterally while still allowing for a degree of flexibility. Accordingly, the shank does not adversely affect the gait of a wearer. The external shank 18 also provides a durable layer of protection for the bottom of the wearer's foot. In the illustrated embodiment, the external shank is made of Thermo Plastic Urethane (TPU), although other stiff and durable materials, such as plastic or polyurethane, could be used.

In other embodiments, the shank 18 can be less than a full length stiffener. For example, the shank can be a three-quarter length stiffener. The shank 18 in other embodiments can extend through the arch area and through the forefoot area but not the heel area. In another embodiment, the shank 18 can extend through the heel area and the arch area, but not through the forefoot area. The shank 18 can be a unitary member or have components coupled together to provide the longitudinal and lateral stiffness desired while still allowing the midsole to flex and bend as needed throughout the wearer's gait.

The shank 18 of the illustrated embodiment is positioned within the recessed portion 32 formed in the midsole 16 between the lugs 30. The shank 18 of the illustrated embodiment is fixed to the midsole with an adhesive or other anchoring mechanism. Accordingly, the shank 18 of the illustrated embodiment is substantially fully exposed and is an external component of the sole assembly 14. As best seen in FIG. 4, the shank 18 has a plurality of protrusions 42 along the lateral and medial portions that are shaped and sized to fit within the channel portions 38 molded into the midsole 16. The protrusions 42 act as a positioning device that help retain the shank 18 in proper position on the midsole 16 during the manufacturing of the sole assembly 14. The protrusions 42 also provide increased surface area to adhere to the midsole 16. The protrusions 42 further act as longitudinal stiffeners for the shank 18 along the medial and lateral portions of the sole assembly 14.

The shank 18 of the illustrated embodiment has a forefoot section 44 integrally connected to an arch section of 46, which is connected to a heel section 48. The forefoot section 44 has a body portion with a pattern that provides lateral stiffness and stability while also allowing for longitudinal flexibility and bending, such as adjacent to the ball of the wearer's foot. The forefoot section 44 has stabilizing edge portion members 50 that wrap upwardly around sidewall/edge areas 52 of the midsole 16. The stabilizing members 50 are positioned with recesses 54 molded in the side wall of the midsole 16 adjacent to the edge area 52. Accordingly, the stabilizing members 50 of the shank's forefoot section 44 in the illustrated embodiment are exposed along the side of the midsole 16 to provide protection to the EVA and to provide visible material differentiation along the side of the sole assembly 14.

The shape and size of the stabilizing members 50 and the molded recesses 54 in the midsole 16 can be different shapes and sizes, particularly as may be desired, inter alia, for aesthetic and/or support reasons. In other embodiments, the stabilizing members can be configured to extend upwardly along the sidewall of the midsole and engage a portion of the shoe's upper adjacent to the midsole. The stabilizing members 50 on the medial and lateral sides can also be different sizes. For example, the stabilizing member on the lateral side (the outside) is taller or larger to provide increased stability to the outside of the wearer's foot. Other embodiments can have a larger stabilizing member of the medial side.

Figure 5:
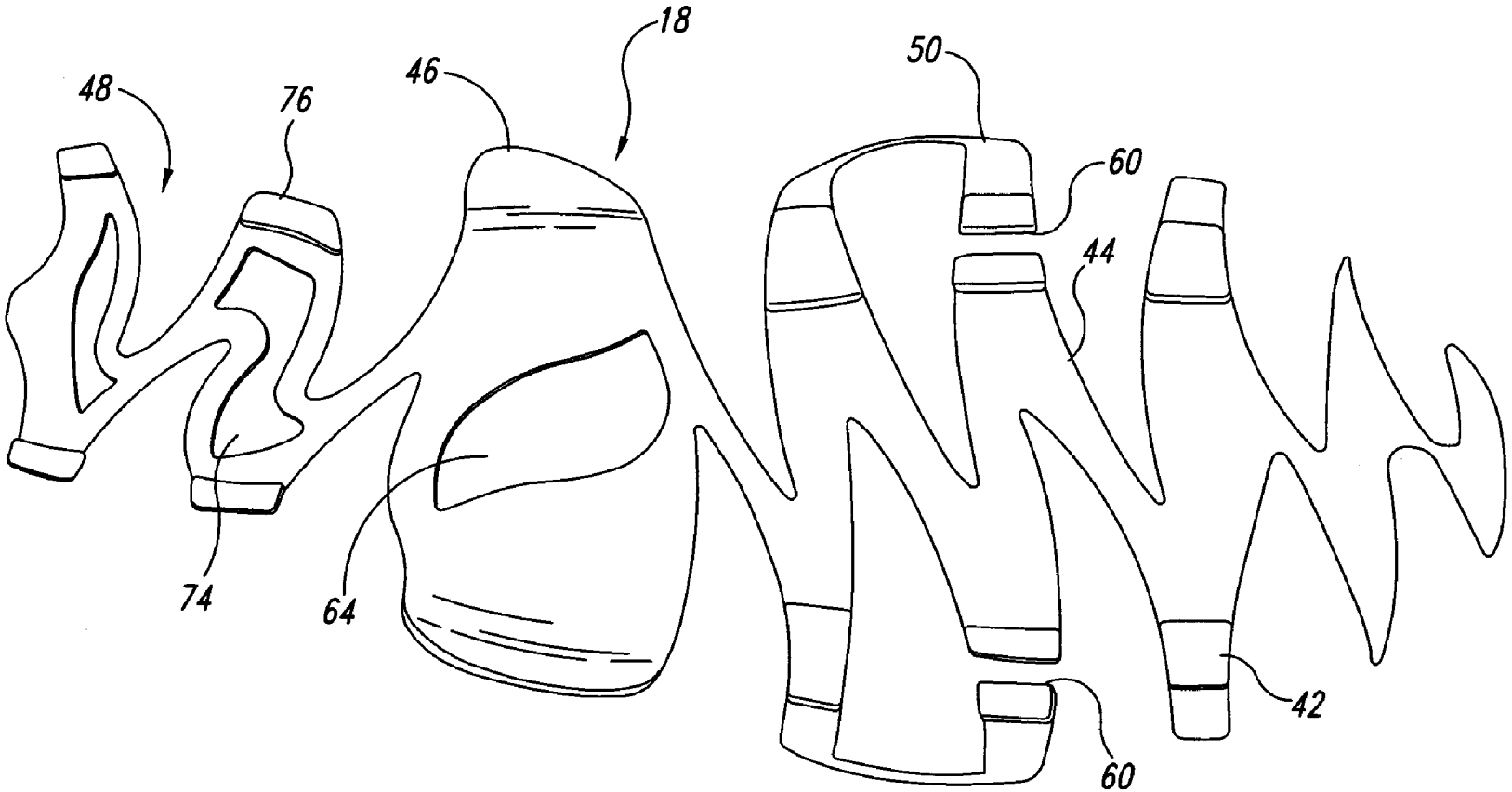
FIG. 5 is an enlarged top plan view of an external shank portion of FIG. 4 shown removed from the midsole.

As best seen in FIGS. 4 and 5, stabilizing members 50 of the forefoot section 44 each have a break 60 formed therein that makes the sole assembly easier to manufacture and assemble. The breaks 60 also allow the shank 18 and the midsole 16 to be formed with less tolerance. Other embodiments can be constructed without the breaks 60 formed in the stabilizing members 50 of the shank 18.

The arch section 46 of the shank 18 is positioned within the recessed portion 32 formed in the midsole 16 at the arch portion 26. The arch section 46 also has stabilizing edge portions or members 51 that wrap around the edges of the midsole and extend upwardly along molded recesses 62 formed in the midsole's sidewall at the arch portion. The arch section 46 in other embodiments can have stabilizing members 51 wrap upwardly along the sidewall of the midsole and along a portion of the shoe's upper. The stabilizing members of the arch section 46 can also be larger or taller to extend higher along the lateral side or the medial sides to provide a desired degree of stability for the user's foot. The size of the stabilizing members 51 on the medial and lateral sides of the arch section can be different depending upon the size of the forefoot sections 44 on the medial and lateral sides.

For example, stabilizing members of the arch section 46 and the forefoot section 44 of the shank on the lateral side can be larger or taller that the respective stabilizing members on the medial sides. Alternatively the stabilizing members 50 of the forefoot section can be larger on the medial side than on the lateral side (e.g., to provide better stability during the toe-off phase of a user's gait), and the stabilizing members 51 of the arch section can be larger or taller on the lateral side than on the medial side (e.g., to provide lateral stability during the transitions in a wearer's gait between heel strike and toe-off). Accordingly, the arch section 46, which is integrally connected to the forefoot section 44 and heel section 48, provides a stable arch support area in the sole assembly 14. In the illustrated embodiment, the arch section 46 has an aperture 64 therein that extends around a logo section molded into the midsole. Other embodiments do not include this aperture for the logo.

In other embodiments, the arch sections 46 of the shank 18 can be partially or fully covered with a portion of the outsole. The arch section 46 can be covered by a layer of resilient outer material that includes a plurality of protruding resilient grip members protruding from the arch area. The grip members of one embodiment are flexible rubber fin structures, although other shapes and materials can be used. The grip members provide additional traction in the arch area. For example, the grip members can provide traction when a wearer steps on a structure (e.g., a ladder rung, an edge of a sidewalk, etc.) in the arch area of the sole assembly. In other embodiments, the arch area of the shank can be provided with texture that can provide increased traction.

The heel section 48 of the shank 18 also has lateral and medial stabilizing edge portions or members 70 that fit within recessed areas 72 molded into the sidewalls of the midsole 16 along the heel portion 28. The heel section 48 of the shank of the illustrated embodiment has a plurality of apertures 74 that provide a degree of longitudinal flexibility of the external shank in the heel portion 28 while maintaining lateral stability. The stiffness characteristics can be different in other embodiments by providing a shank without the apertures or with larger apertures. The heel section 48 also includes protrusions 76 that fit within the channels 38 molded into the lateral and medial portions of the midsole 16 to facilitate the positioning and retention of the shank.

Figure 6:
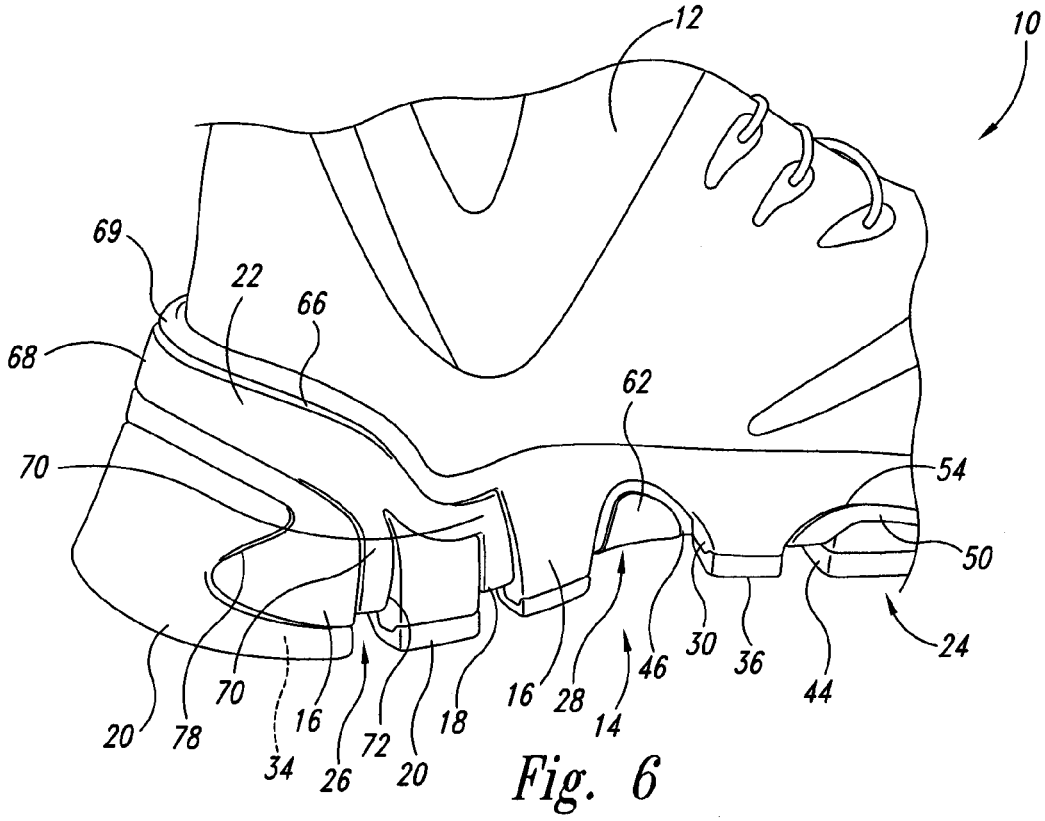
FIG. 6 is an enlarged side view of a heel portion of the boot assembly of FIG. 1.
Figure 7:
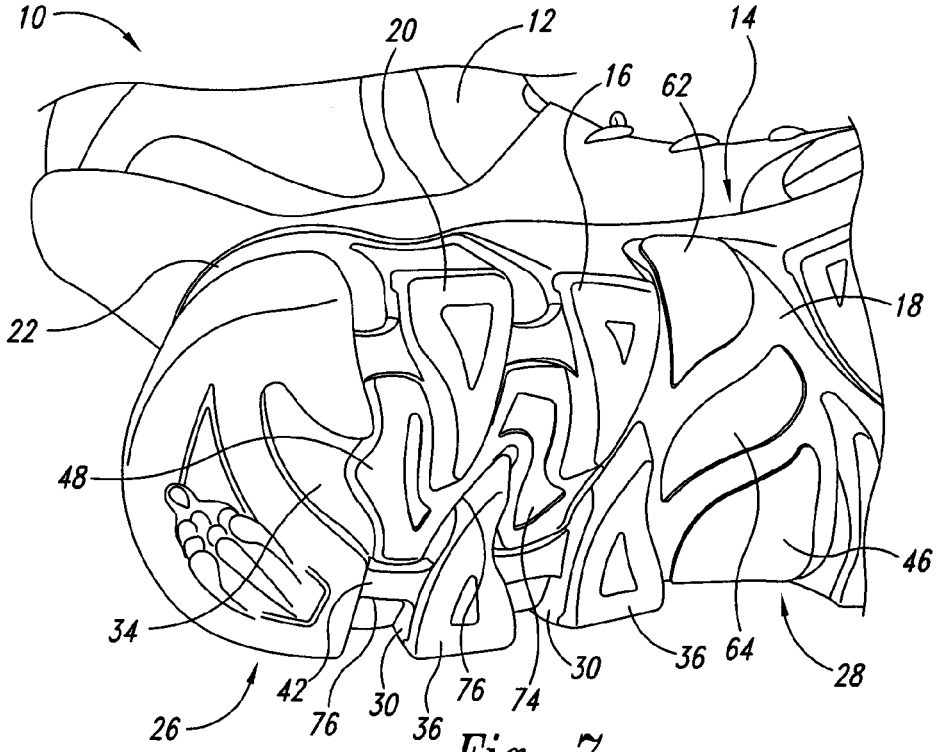
FIG. 7 is an enlarged bottom view of the heel portion of the boot assembly of FIG. 1.

FIG. 6 is an enlarged side view of the heel portion 28 of the sole assembly 10, and FIG. 7 is an enlarged bottom plan view of the heel portion. The midsole 16 in the heel portion 28 has a recessed area 66 along the side walls and around the heel portion. The recessed area 66 in the midsole 16 receives a heel wrap section 68 of the shank 18. The heel wrap section 68 in the illustrated embodiment is integrally connected to the stabilizing member and is made of TPU, although other relatively stiff or rigid materials can be used in other embodiments. The heel wrap section 68 extends around the back of the midsole and provides a stabilizing and protective structure around the heel. The stabilizing members 70 and the heel wrap section 68 form the heel wrap 22 that can help define a heel cup within the boot assembly 10 for improved fit and comfort. The heel wrap 22 of the illustrated embodiment is connected to the heel section 48 of the shank 18. The heel wrap 22 can be attached to the heel section 48 during manufacture of the sole assembly 14. In other embodiments, the heel wrap 22 can be integrally connected to the heel section 48 of the shank 18.

The heel wrap 22 in other embodiments can also wrap upwardly along the side of the midsole and along a portion of the shoe's upper around the heel area. The stabilizing members 70 of the heel wrap 22 can also be larger or extend higher along one side of the shoe (e.g., medial or lateral side) before it wraps around the heel area. For example, the heel wrap 22 can extend higher along the lateral side of the shoe than on the medial side to provide support and stability to the wearer's foot during heel strike. Accordingly, the heel wrap 22 can have an asymmetric configuration. The heel wrap 22 can also be contoured to accommodate the shape of a wearer's heel area for purposes of stability, comfort, and support.

In one embodiment, the shank 18 is formed of a translucent or a substantially transparent material (e.g., a TPU or plastic material). A pattern or image can be provided in or on the midsole so that the pattern or image is visible through the shank 18. In one embodiment, a camouflage pattern is provided on the midsole, so that the camouflage pattern is visible through the shank 18.

Figure 8:
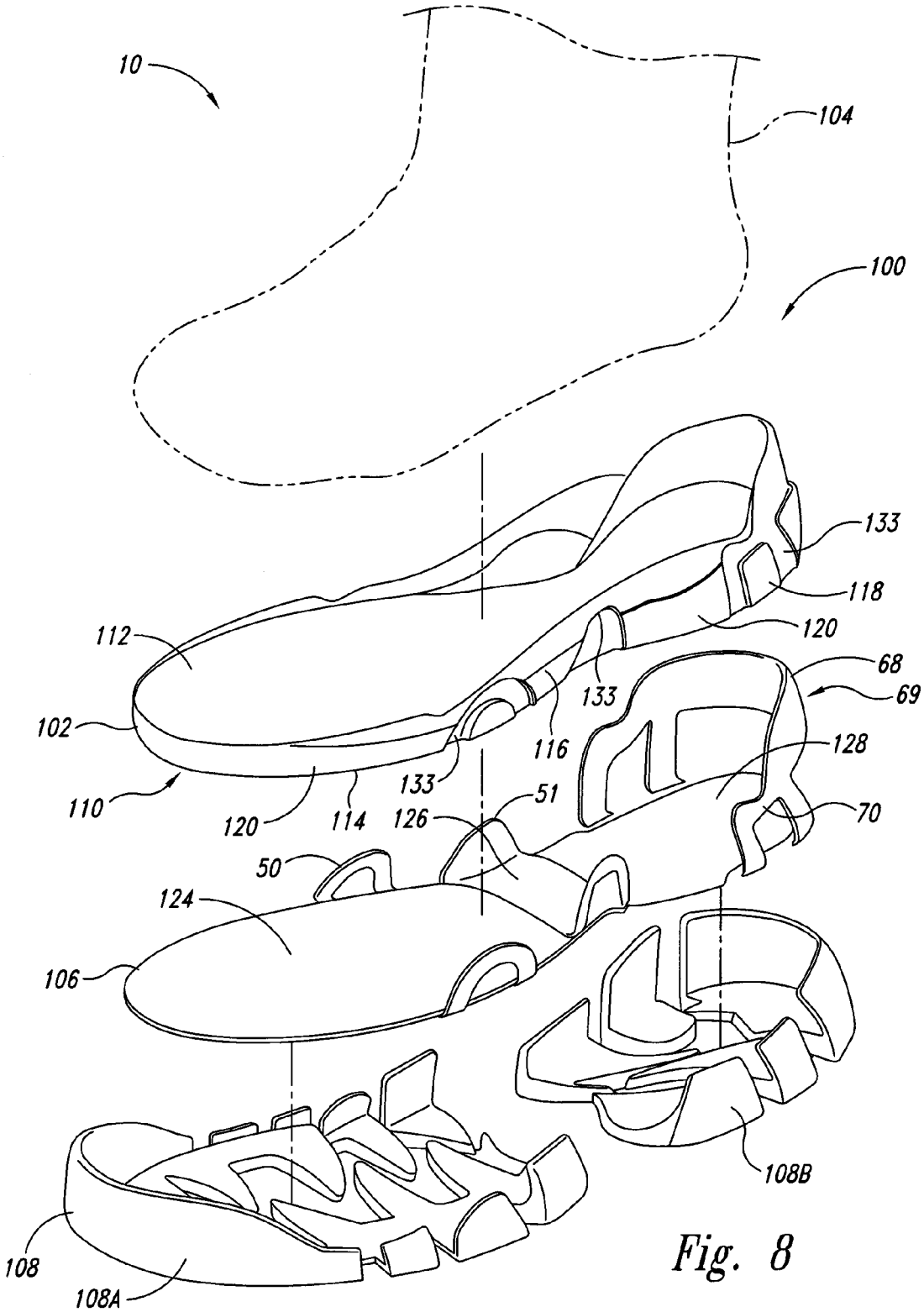
FIG. 8 is a partially exploded isometric view of a sole assembly in accordance with another embodiment.
Figure 9:
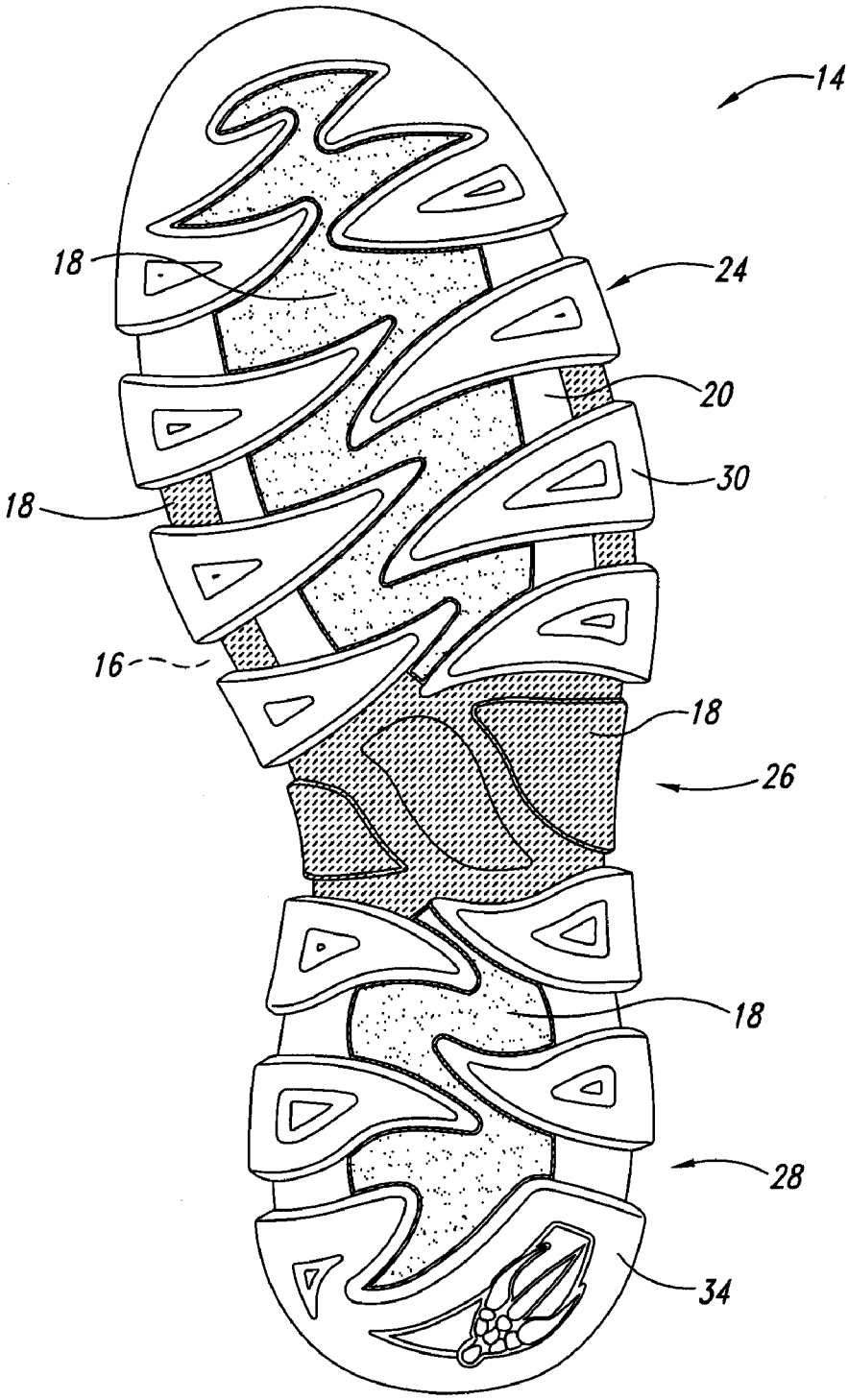
FIG. 9 is a bottom plan view of a sole assembly having an external shank in accordance with another embodiment.

As best seen in FIGS. 8 and 9, the outsole material attached to the heel lug 34 provides a surface that engages the ground, such as during heel strike. The outsole material can wrap upward around the heel lug and up the back wall of the midsole at the heel portion 28. The outsole material covering the heel lug 34 provides a durable heel area of the sole assembly 14. The outsole material that wraps around the back of the midsole 16 is retained in a recessed area 78 molded into the midsole. Accordingly, the sole assembly 14 has a generally smooth and continuous surface as the sole assembly transitions between the outsole material, the EVA midsole material, and the TPU shank material.

The sole assembly with the EVA midsole and the TPU shank 18 with the rubber outsole 20 provide a very durable and rugged boot having a very lightweight assembly without sacrificing the structural rigidity and performance of a hiking boot, hunting boot, or work boot.

The three materials used in the sole assembly 14 of the illustrated embodiment, namely the EVA, TPU, and the rubber of the outsole, can all have the same color (shown in the illustrated embodiment as being black). In other embodiments, the different materials can be different colors, for example, for aesthetic purposes. The materials for the midsole 16, the shank 18, and the outsole 20 can also have different textures to provide a visual difference in these components. Such visual differences can be appealing aesthetically for marketing and other purposes.

In another embodiment, the lugs 30 can be integrally formed in the outsole 20, and the outsole secured to the midsole 16 (FIG. 6) along an interior surface that faces the midsole. The lugs extend away from the midsole and form the surface that engages the ground. In at least one embodiment, the shank is an external shank attached to an outer surface of the outsole between the lugs, such that the lugs protrude through the shank or appear to protrude through the shank. The shank can include stabilizing members 50 and 51 and/or the heel wrap as discussed above. The shank can be transparent or translucent so portions of the outsole and/or the midsole can be seen through the shank. In other embodiments, only portions of the shank are transparent or translucent.

Figure 10:
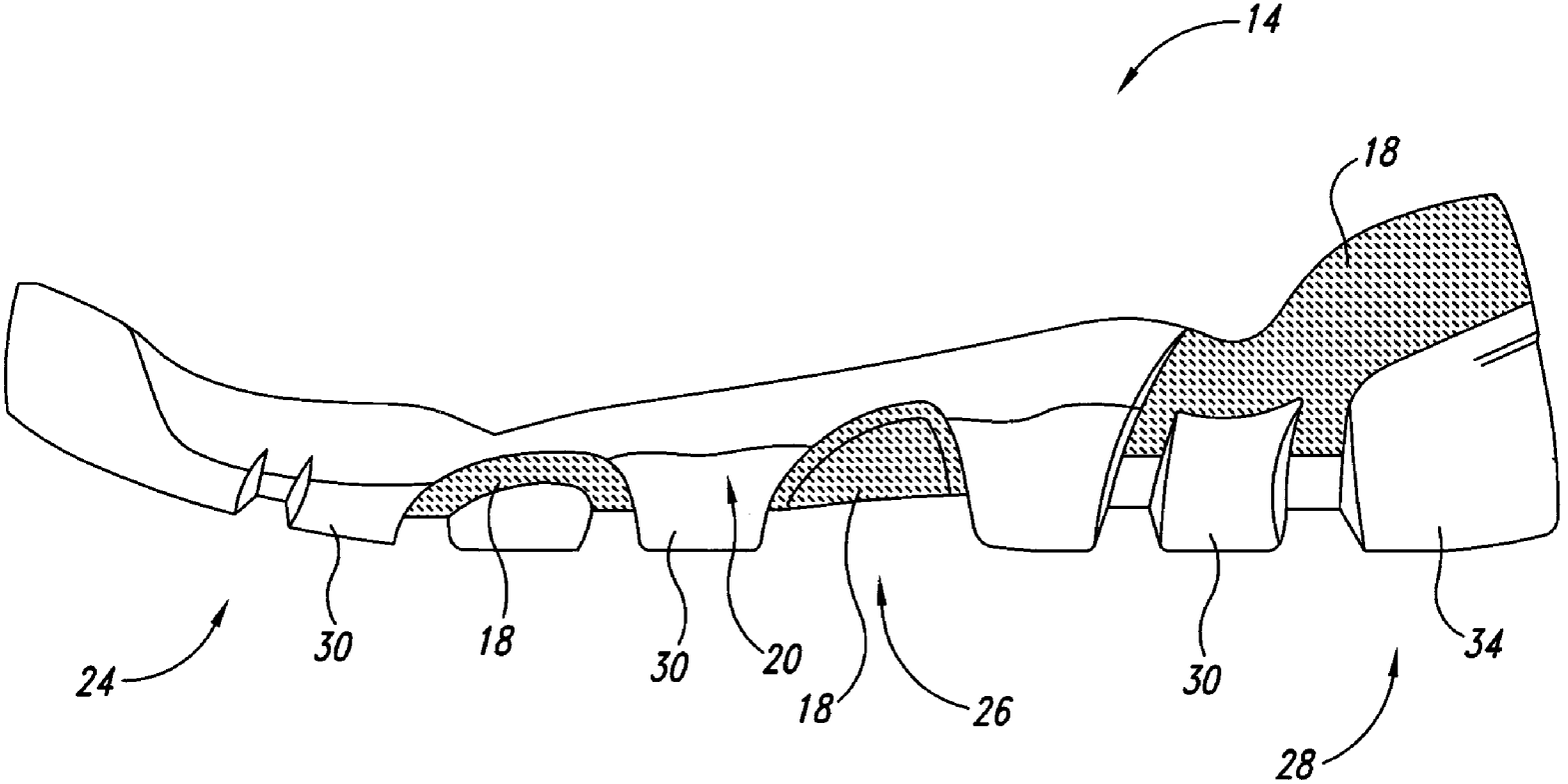
FIG. 10 is a side elevation view of the sole assembly of FIG. 9.

FIG. 8 is a partially exploded isometric view of a sole assembly 100 of a boot assembly 10 in accordance with another embodiment. FIG. 9 is a bottom plan view of the sole assembly 100 and FIG. 10 is a side elevation view. The sole assembly 100 has a lightweight midsole 102 attached to an upper 104 (shown in phantom lines), a shank 106 attached to the midsole, and a durable outsole 108 attached to the shank 106. The midsole 102 of the illustrated embodiment is a molded, closed cell, or other lightweight compressible material, such as EVA. The midsole 102 could also be made of a dual-density material, as discussed above.

The midsole 102 has a generally flat bottom surface 110 adhered or otherwise secured to portions of the shank 106, and an upper surface 112 securely attached to the upper 104. The midsole 102 has a forefoot portion 114, an arch portion 116, and a heel portion 118. In the illustrated embodiment, sidewalls 120 of the midsole 102 have recesses 133 formed in each of the forefoot portion 114, the arch portion 116, and the heel portion 118. The recesses 133 are shaped and sized to receive portions of the shank 106, discussed in greater detail below. In other embodiments, recesses can be provided in only one or more of the forefoot, arch, and heel portions. In yet other embodiments, recesses need not be provided in the sidewalls 120.

The shank 106 of the illustrated embodiment has a forefoot portion 124 attached to the midsole's forefoot portion 114, an arch portion 126 attached to the midsole's arch portion 116, and a heel portion 128 attached to the midsole's heel portion 118. The shank 106 of the illustrated embodiment is a full-length shank formed of a stiff and substantially non-compressible material, such as TPU. Other materials, such as plastics, urethanes, polyurethanes, etc., could be used in other embodiments. Other embodiments can have ¾-length shanks, ½-length shanks, or other size shanks.

The outsole assembly 108 is shown as a two-piece outsole with a forward section 108A and a rear section 108B. The forward section is attached to the forefoot portion 124 of the shank and extends forwardly from the arch portion 126 through the forefoot portion. The rear section 108B is attached to the heel portion 128 of the shank and extends rearwardly from the arch portion 126 through the heel portion. Accordingly, the arch portion of the shank in the illustrated embodiment is exposed. In other embodiments, the front and rear sections 108A and 108B can be connected together by outsole material that can partially cover parts of the shank's arch portion. In another embodiment, the outsole can be a full-length outsole that covers the shank from heel to toe. In another embodiment, portions of the shank's forefoot portion 124 and/or heel portion 128 can be exposed.

The outsole assembly 108 of the illustrated embodiment is constructed with a tread pattern that can include lugs or other tread features. Portions of the forward and/or rear sections are constructed with a transparent or translucent outsole material. For example, the transparent or translucent material, such as durable rubber, can be provided between the tread features. Accordingly, portions of the shank can be seen through the transparent or translucent material. The shank can be provided with designs, patterns, text, camouflage, logos, colors, or other visual images that can be seen through the outsole. In other embodiments, the outsole can be made of opaque material.

In the illustrated embodiment, the shank includes the stabilizing members 50 at the forefoot portion, stabilizing members 51 at the arch portion, and the heel wrap 22 at the heel portion as discussed above. The shank in other embodiments can have other configurations or combinations of the stabilizing members and/or the heel wrap. For example, in one embodiment, the shank has the stabilizing members in the arch portion and the heel wrap, but not the forefoot stabilizing members. In another embodiment, the shank only has the heel wrap 22. In yet other embodiments the shank only has the forefoot stabilizing members.

Figure 11:
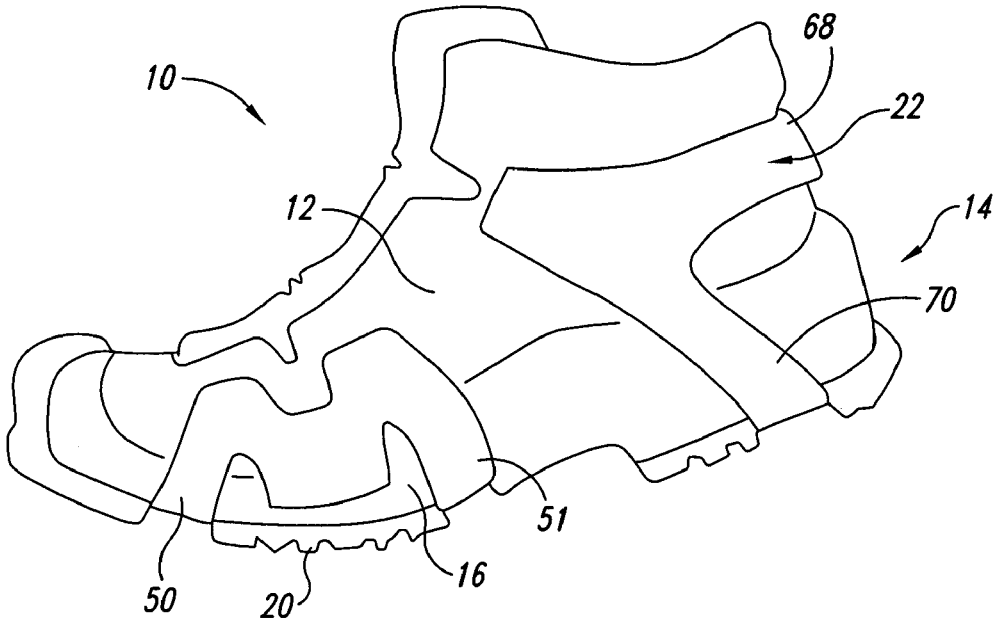
FIG. 11 is a schematic side elevation view of a boot assembly in accordance with another embodiment.
Figure 12:
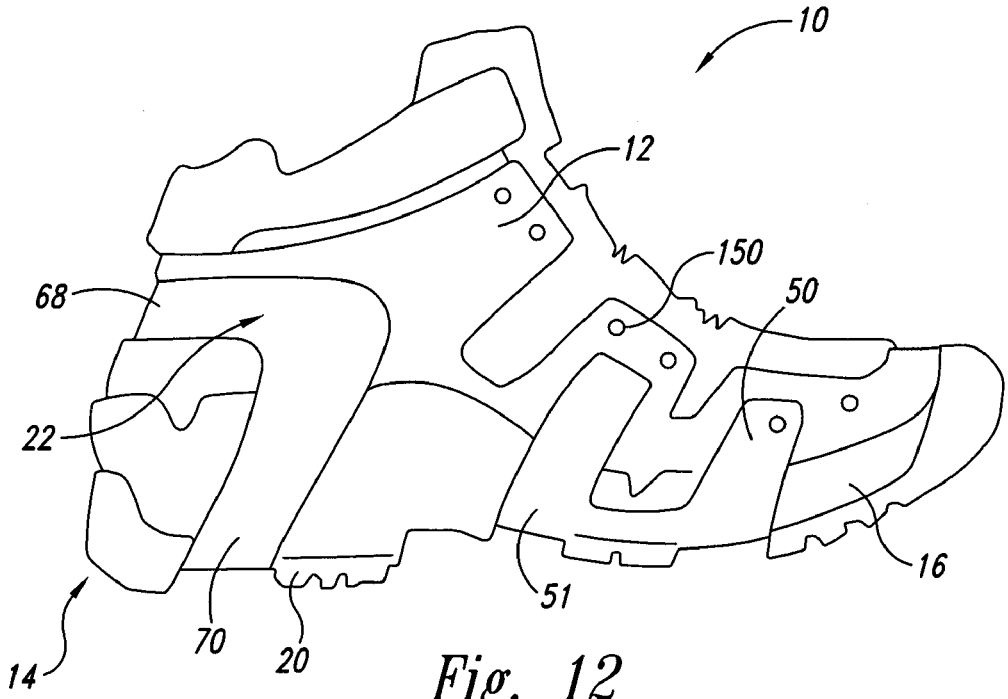
FIG. 12 is a schematic side elevation view of a boot assembly in accordance with yet another embodiment.

FIGS. 11 and 12 are side elevation views of other embodiments wherein stabilizing members of the shank extend upwardly from the sidewalls of the midsole and extend along portions of the shoe's upper. The stabilizing members extend along the upper and are connected to the upper's fit system 150, such as the laces or the like. Accordingly, the shank system supports and cradles the wearer's foot while in the shoe.

Figure 13:
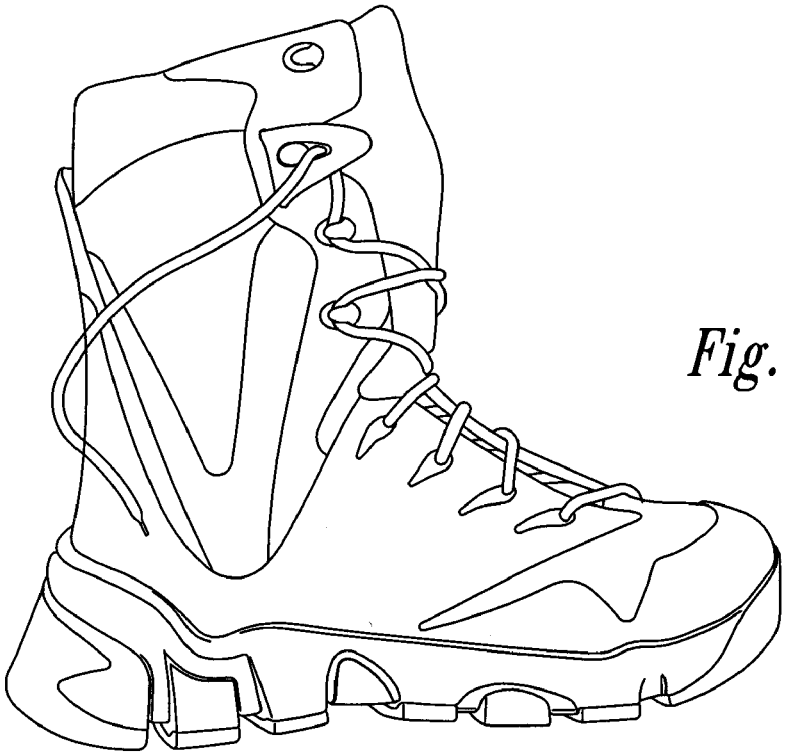
FIG. 13 is a right side elevation view of the boot assembly having an external shank.
Figure 14:
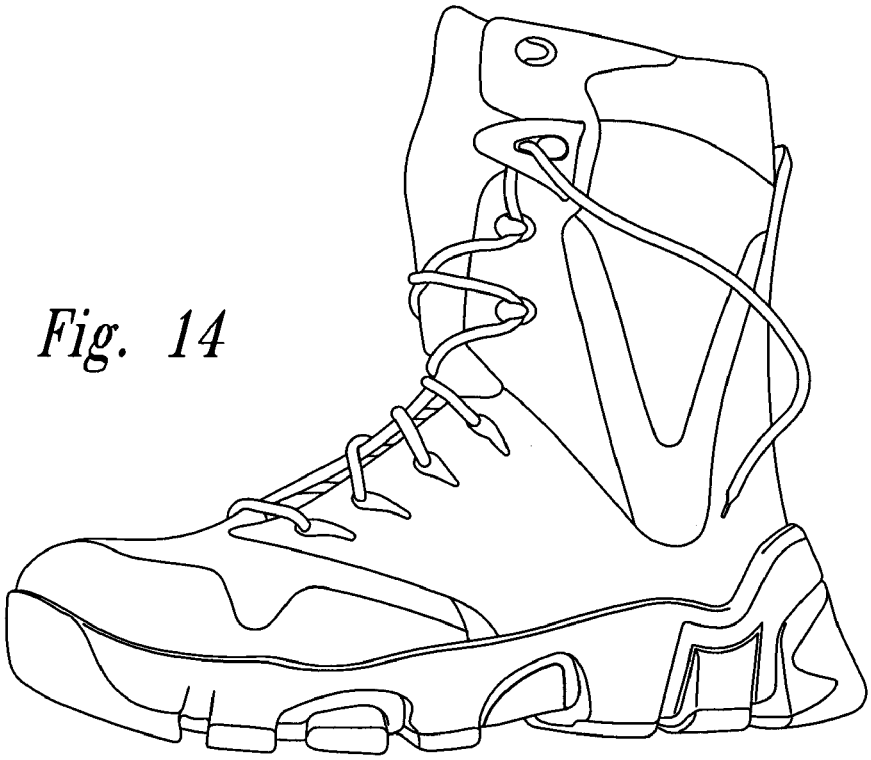
FIG. 14 there is a left side elevation view of the boot assembly of FIG. 13.
Figure 15:
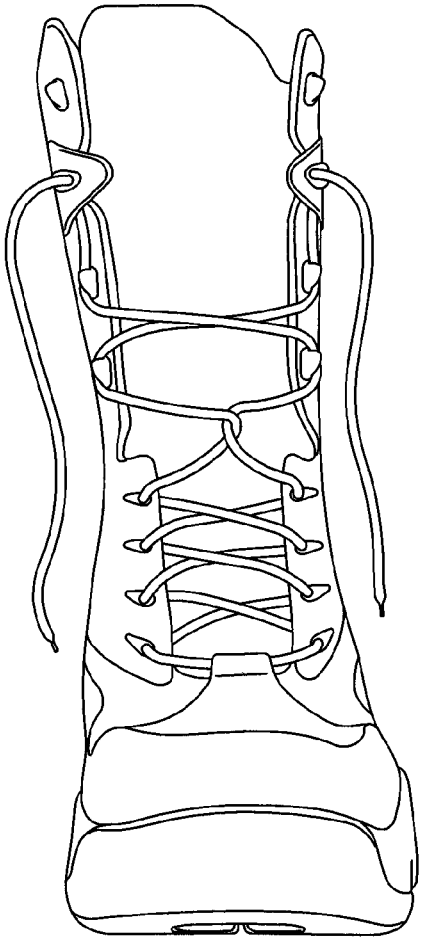
FIG. 15 is a front elevation view of the boot assembly of FIG. 13.
Figure 16:
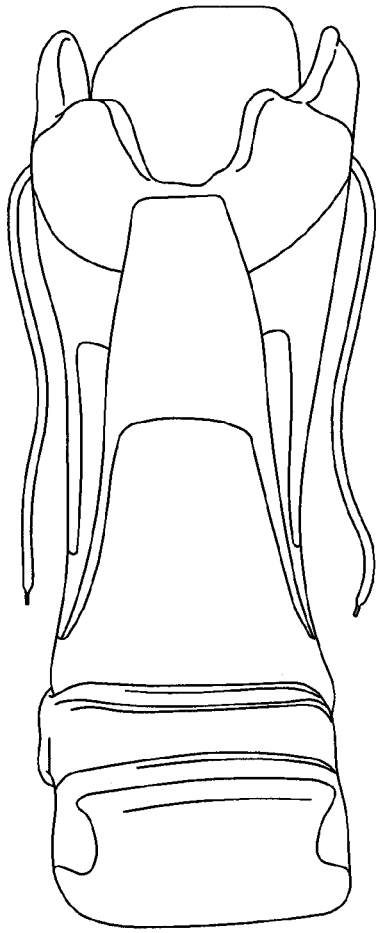
FIG. 16 is a rear elevation view of the boot assembly of FIG. 13.
Figure 17:
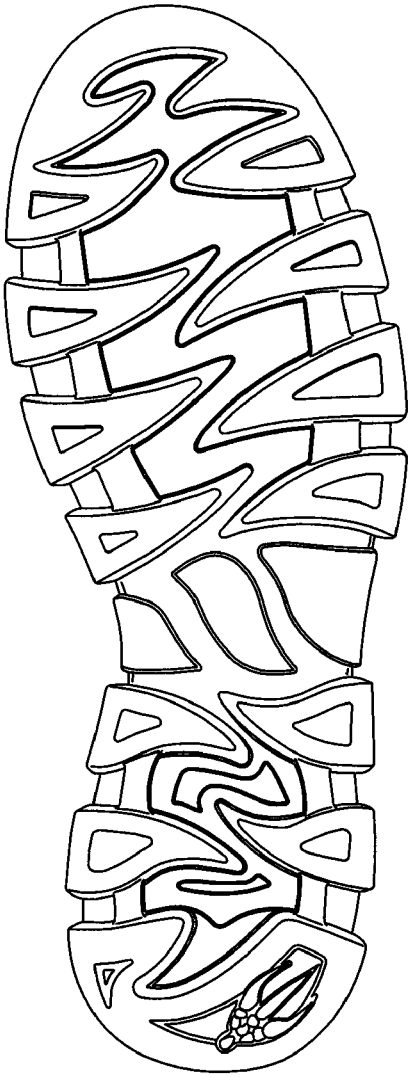
FIG. 17 is a bottom view of the boot assembly of FIG. 13.
Figure 18:
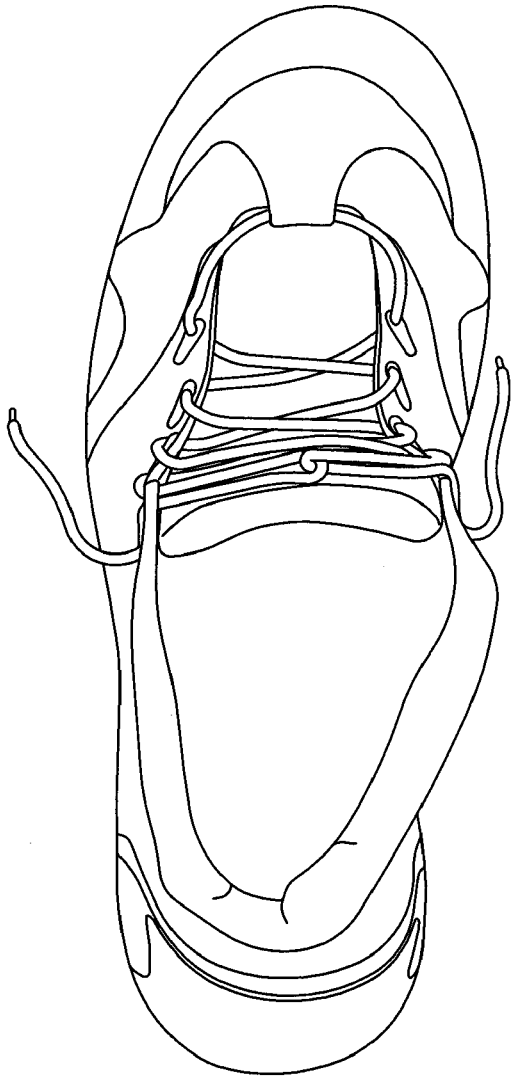
FIG. 18 is a top view of the boot assembly of FIG. 13.

FIG. 13 is a right side elevation view of a boot showing an ornamental design of one embodiment of a boot assembly. FIG. 14 is a left side elevation view of the boot of FIG. 13. FIG. 15 is a front elevation view of the boot of FIG. 13. FIG. 16 is a rear elevation view of the boot of FIG. 13. FIG. 17 is a bottom view of the boot of FIG. 13, and FIG. 18 is a top view of the boot of FIG. 13.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A footwear assembly, comprising:

an upper; and a sole assembly connected to the upper, the sole assembly comprising:

a midsole made of a first material and having a forefoot portion, an arch portion, a heel portion, and a sidewall extending around a lateral side, a medial side, and a heel side of the midsole, wherein the sidewall of the midsole has a recessed portion therein;

a stiffener connected to the midsole, the stiffener being made of a second material stiffer than the first material, the stiffener having a base portion adjacent to the arch portion and at least one of the forefoot portion and the heel portion of the midsole, the stiffener having at least one side stabilizer and a heel wrap coupled to the base portion, the side stabilizer being adjacent to the sidewall in at least one of the arch portion and forefoot portion, wherein the side stabilizer is positioned in the recessed portion, the heel wrap being adjacent to the heel side and at least one of the lateral side and medial side of the midsole's sidewall; and an outsole connected to at least one of the midsole and the stiffener.

2. The footwear assembly of claim 1 wherein the at least one side stabilizer includes a lateral stabilizer adjacent to the lateral side of the midsole at the forefoot portion and a medial stabilizer adjacent to the medial side of the midsole at the forefoot portion of the midsole.

3. The footwear assembly of claim 1 wherein the at least one side stabilizer is integrally connected to the base portion.

4. The footwear assembly of claim 1 wherein the heel wrap has a lateral side portion coupled to the base portion and adjacent to the sidewall's lateral side, medial side portion coupled to the base portion and adjacent to the sidewall's medial side, and a heel side extending between the medial side portion and the lateral side portion.

5. The footwear assembly of claim 1 wherein the heel wrap has a lateral side portion adjacent to the sidewall's lateral side, a medial side portion coupled to the base portion, and a heel side extending between the medial side portion and the lateral side portion.

6. The footwear assembly of claim 1 wherein the sidewall comprises lateral and medial sidewalls, and the at least one stabilizer comprises has a first lateral side stabilizer adjacent to the arch portion of the midsole and a first medial side stabilizer adjacent to the medial side of the arch portion of the midsole, the stiffener having a second lateral side stabilizer adjacent to the forefoot portion of the midsole and a second medial side stabilizer adjacent to the medial side of the forefoot portion of the midsole.

7. The footwear assembly of claim 1 wherein the at least one stabilizer comprises first and second stabilizers and the sidewall of the midsole has recessed portions in the lateral and medial sides of the midsole's sidewall, and the first and second stabilizers are positioned in the recessed portions.

8. The footwear assembly of claim 1 wherein the outsole has a forefoot portion adjacent to the midsole's forefoot portion and a heel portion adjacent to the midsole's heel portion.

9. The footwear assembly of claim 1 wherein the outsole has a translucent portion and the stiffener is visible through the translucent portion.

10. The footwear assembly of claim 1 wherein the outsole has a forefoot portion adjacent to the midsole's forefoot portion and a heel portion adjacent to the midsole's heel portion and the base portion of the stabilizer adjacent to the arch portion has an external surface not covered by the outsole.

11. The footwear assembly of claim 1 wherein the midsole is made of a closed-cell foam material and the stiffener is made one of a plastic, polyurethane, and thermo plastic urethane material.

12. The footwear assembly of claim 1 wherein the stiffener is a substantially full length member extending between the forefoot portion and the heel portion of the midsole.

13. The footwear assembly of claim 1 wherein the base portion of the stiffener has a plurality of apertures, and the midsole has a plurality of lugs that extend through the plurality of apertures.

14. The footwear assembly of claim 1 wherein portions of the stiffener's base portion are visible and not covered by the outsole.

15. The footwear assembly of claim 1 wherein the stiffener is an external shank that provides longitudinal and lateral stability for the sole assembly.

16. The footwear assembly of claim 1 further comprising a longitudinal shank coupled to the midsole.

17. The footwear assembly of claim 1 wherein the stiffener is a unitary member.

18. A footwear assembly, comprising:

an upper; and a sole assembly connected to the upper, the sole assembly comprising:

a midsole made of a first material and having a forefoot portion, an arch portion, a heel portion, and a sidewall extending around a lateral side, a medial side, and a heel side of the midsole;

a stiffener connected to the midsole, the stiffener being made of a second material stiffer than the first material, the stiffener having a base portion adjacent to the arch portion and at least one of the forefoot portion and the heel portion of the midsole, the stiffener having at least one side stabilizer and a heel wrap coupled to the base portion, the side stabilizer being adjacent to the sidewall in at least one of the arch portion and forefoot portion, the heel wrap being adjacent to the heel side and at least one of the lateral side and medial side of the midsole's sidewall; and an outsole connected to at least one of the midsole and the stiffener; and wherein the stiffener is made of a substantially transparent or translucent material, and further comprising a pattern or image coupled to the midsole and being visible through the stiffener.

19. A footwear assembly, comprising:

an upper; and a sole assembly connected to the upper, the sole assembly comprising:

a midsole made of a first material and having a sidewall, a forefoot portion, an arch portion, and a heel portion, wherein the sidewall of the midsole has a recessed portion therein;

a stiffener connected to the midsole, the stiffener being made of a second material stiffer than the first material, the stiffener having a base portion adjacent to the arch portion, wherein a portion of the stiffener is positioned in the recessed portion, the stiffener having arch stabilizers adjacent to the midsole's sidewall at the arch portion, and the stiffener having a heel wrap adjacent to the heel portion, the heel wrap having medial and lateral portions adjacent to the midsole's sidewall, and a wrap portion adjacent to the sidewall and extending between the medial and lateral portions and being uncovered and visible from an exterior of the footwear assembly; and an outsole connected to at least one of the midsole and the stiffener.

20. The footwear assembly of claim 19 wherein the stiffener includes a lateral stabilizer adjacent to the lateral side of the midsole at the forefoot portion and a medial stabilizer adjacent to the medial side of the midsole at the forefoot portion of the midsole.

21. The footwear assembly of claim 19 wherein the stiffener includes forefoot side stabilizers connected to the base portion and positioned adjacent to the sidewalls at the forefoot portion of the midsole.

22. The footwear assembly of claim 19 wherein the stiffener has two side stabilizers and the sidewall of the midsole has two recessed portions and the two side stabilizers are positioned in the corresponding recessed portions.

23. The footwear assembly of claim 19 wherein the outsole has a forefoot portion adjacent to the midsole's forefoot portion and a heel portion adjacent to the midsole's heel portion and the arch portion of the stiffener being uncovered and exposed.

24. The footwear assembly of claim 19 wherein the outsole has a translucent portion and the stiffener is visible through the translucent portion.

25. The footwear assembly of claim 19 wherein the stiffener is an external shank that provides longitudinal and lateral stability for the sole assembly.

26. A footwear assembly, comprising:

an upper; and a sole assembly connected to the upper, the sole assembly comprising:

a midsole made of a first material and having a sidewall, a forefoot portion, an arch portion, and a heel portion;

a stiffener connected to the midsole, the stiffener being made of a second material stiffer than the first material, the stiffener having a base portion adjacent to the arch portion, the stiffener having arch stabilizers adjacent to the midsole's sidewall at the arch portion, and the stiffener having a heel wrap adjacent to the heel portion, the heel wrap having medial and lateral portions adjacent to the midsole's sidewall, and a wrap portion adjacent to the sidewall and extending between the medial and lateral portions and being uncovered and visible from an exterior of the footwear assembly; and an outsole connected to at least one of the midsole and the stiffener; and wherein the stiffener is made of a substantially translucent material, and further comprising a pattern or image coupled to the midsole and being visible through the stiffener.

27. A footwear assembly, comprising:

an upper; and a sole assembly connected to the upper, the sole assembly comprising a midsole made of a first material and having a plurality of lugs projecting away from the upper and defining recessed areas, a stiffener connected to the midsole in at least some of the recessed areas, the stiffener having a plurality of apertures and the plurality of lugs project through the apertures, the stiffener being made of a second material stiffer than the first material, the midsole having a forefoot portion, an arch portion and a heel portion, the stiffener being positioned in the arch portion and in at least one of the forefoot portions and the heel portions, and the sole assembly having an outsole connected to the lugs.

28. The footwear assembly of claim 27 wherein the outsole is adhered to the lugs and is spaced apart from the recessed areas.

29. The footwear assembly of claim 27 wherein the stiffener is a substantially full length member extending between the forefoot portion and the heel portion.

30. The footwear assembly of claim 27 wherein the lugs extend through the stiffener in the heel portion and forefoot portion only.

31. The footwear assembly of claim 27 wherein the stiffener is an external shank that provides longitudinal and lateral stability for the sole assembly.

32. The footwear assembly of claim 27 wherein the stiffener includes a heel wrap portion connected to the heel portion of the midsole and positioned adjacent to a sidewall of the midsole at the heel portion.

33. The footwear assembly of claim 27 wherein the midsole has lateral and medial sidewalls, and the stiffener has a lateral stabilizer adjacent to the lateral sidewall of the forefoot portion of the midsole and a medial stabilizer adjacent to the medial sidewall of the forefoot portion of the midsole.

34. The footwear assembly of claim 27 wherein the midsole has lateral and medial sidewalls, the stiffener has a lateral stabilizer adjacent to the lateral sidewall of the heel portion of the midsole, a medial stabilizer adjacent to the medial sidewall of the heel portion of the midsole, and a heel wrap portion connected to the medial and lateral stabilizers.

35. The footwear assembly of claim 27 wherein the midsole has lateral and medial sidewalls, the stiffener has a first lateral stabilizer adjacent to the lateral sidewall of the arch portion of the midsole and a first medial stabilizer adjacent to the medial sidewall of the arch portion of the midsole, the stiffener having a second lateral stabilizer adjacent to the lateral sidewall of the forefoot portion of the midsole and a second medial stabilizer adjacent to the medial sidewall of the forefoot portion, the stiffener having a third lateral stabilizer adjacent to the lateral sidewall of the heel portion of the midsole and a third medial stabilizer adjacent to the medial sidewall of the heel portion.

36. The footwear assembly of claim 27 wherein the midsole has lateral and medial sidewalls, the stiffener has a first lateral stabilizer adjacent to the lateral sidewall of the arch portion of the midsole and a first medial stabilizer adjacent to the medial sidewall of the arch portion of the midsole, the stiffener having a second lateral stabilizer adjacent to the lateral sidewall of the forefoot portion of the midsole and a second medial stabilizer adjacent to the medial sidewall of the forefoot portion, the stiffener having a third lateral stabilizer adjacent to the lateral sidewall of the heel portion of the midsole and a third medial stabilizer adjacent to the medial sidewall of the heel portion, and a heel wrap portion integrally connected to the third lateral and medial stabilizers and extending along the midsole between the lateral and medial sidewalls of the heel portion.

37. A footwear assembly, comprising:

an upper; and a sole assembly connected to the upper, the sole assembly comprising a midsole made of a first material and having a plurality of lugs projecting away from the upper and defining recessed areas, a stiffener connected to the midsole in at least some of the recessed areas, the stiffener having a plurality of apertures and the plurality of lugs project through the apertures, the stiffener being made of a second material stiffer than the first material, the midsole having a forefoot portion, an arch portion and a heel portion, the stiffener being positioned in the arch portion and in at least one of the forefoot portions and the heel portions, and the sole assembly having an outsole connected to the lugs; and wherein the stiffener is made of a substantially transparent or translucent material, and further comprising a pattern or image coupled to the midsole and being visible through the stiffener.

38. A method of making a footwear assembly, comprising:

providing a midsole with a sidewall, a forefoot portion, an arch portion and a heel portion;

positioning first portions of the stiffener in recessed portions formed in medial and lateral sidewall portions of the midsole's arch portion, and positioning second portions of the stiffener adjacent to medial and lateral sidewall portions of at least one of the midsole's forefoot portions and the heel portions; and adhering an outsole to at least one of the midsole and the stiffener.

39. The method of claim 38 wherein positioning the second portions of the stiffener includes positioning the second portions in recessed portions formed in the medial and lateral sidewall of the at least one of the midsole's forefoot and heel portions.

* * * * *

UNITED STATES PATENT AND TRADEMARK OFFICE

CERTIFICATE OF CORRECTION

PATENT NO. : 7,647,709 B2
APPLICATION NO. : 11/437266
DATED : January 19, 2010
INVENTOR(S) : Reilly et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 635 days.

Signed and Sealed this

Twenty-eighth Day of December, 2010

David J. Kappos

David J. Kappos
*Director of the United States Patent and Trademark Office*